US005333921A

United States Patent [19]

Dinsmoor, III

[11] Patent Number: 5,333,921

[45] Date of Patent: Aug. 2, 1994

[54] ADJUSTABLE COVER AND SEATING SYSTEM FOR A WHEELCHAIR

[75] Inventor: John C. Dinsmoor, III, Westminister, Colo.

[73] Assignee: Jay Medical, Ltd., Boulder, Colo.

[21] Appl. No.: 945,736

[22] Filed: Sep. 16, 1992

[51] Int. Cl.[5] ..... A47C 27/00

[52] U.S. Cl. ..... 297/219.1; 297/228.11; 297/DIG. 4

[58] Field of Search ..... 297/219.1, 224, 228.11, 297/228.1, 220, DIG. 4

[56] References Cited

U.S. PATENT DOCUMENTS

| | | | |
|---|---|---|---|
| Re. 25,537 | 3/1964 | Larkin | 297/228.11 |
| 1,468,072 | 9/1923 | Ogle . | |
| 2,091,825 | 8/1937 | Mednick | 297/224 |
| 2,782,840 | 2/1957 | Armbrecht | 297/228.11 |
| 3,003,816 | 10/1961 | Wilson | 297/228.11 |
| 3,222,694 | 12/1965 | Schick | 297/219.1 |
| 3,611,455 | 10/1971 | Gottfried | 5/348 |
| 4,588,229 | 5/1986 | Jay | 297/459 |
| 4,643,481 | 2/1987 | Saloff | 297/458 |
| 4,660,238 | 4/1987 | Jay | 5/431 |
| 4,693,511 | 9/1987 | Seltzer | 297/224 |
| 4,726,624 | 2/1988 | Jay | 297/459 |
| 4,728,551 | 3/1988 | Jay | 428/76 |
| 4,761,843 | 8/1988 | Jay | 5/431 |
| 4,842,330 | 6/1989 | Jay | 297/4 |
| 4,946,221 | 8/1990 | Livingston | 297/224 |
| 4,958,886 | 9/1990 | Barattini | 297/224 |
| 5,018,790 | 5/1991 | Jay | 297/458 |
| 5,062,677 | 11/1991 | Jay | 297/444 |
| 5,074,620 | 12/1991 | Jay | 297/444 |
| 5,121,938 | 6/1992 | Gross | 297/228.1 |
| 5,201,780 | 4/1993 | Dinsmoor | 5/455 |

*Primary Examiner*—P. Austin Bradley
*Assistant Examiner*—James Miner
*Attorney, Agent, or Firm*—W. Scott Carson

[57] ABSTRACT

An adjustable cover and seating system for a wheelchair. The cover has a first or enclosing portion surrounding the inner seat members and a second or skirt portion extending about the sides of the first or enclosure portion and downwardly under the lower section of the enclosure portion. The first or enclosure portion of the cover can be placed over the seating members and secured in place by a zipper to encase the seating member. The skirt section can then be pulled to draw the skirt section downwardly which, in turn, draws the upper section of the enclosure portion snugly across the top of the seating members. In doing so, the peripheral side section of the enclosure portion is also drawn downwardly on itself into gathers or bunches which are held firmly in place against the seating members by the skirt section. This serves to present a neat outer appearance to the user and to prevent excess material from catching in the spokes of the wheelchair. The seating system includes a unique slit or cut-out fluid pad forming sides which can be positioned to straddle a removable accessory such as an abductor. Additionally, the sides can be placed substantially adjacent each other on the base seating member when the removable abductor is not used.

22 Claims, 8 Drawing Sheets

Fig. 2
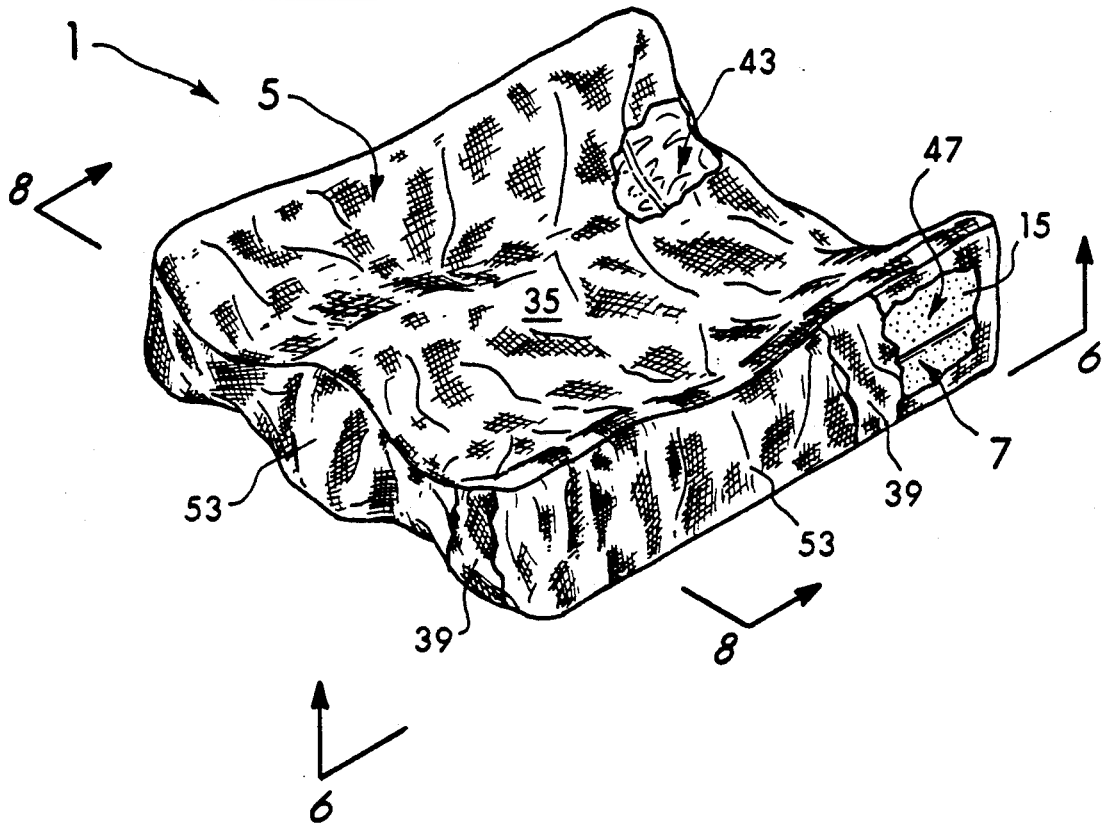
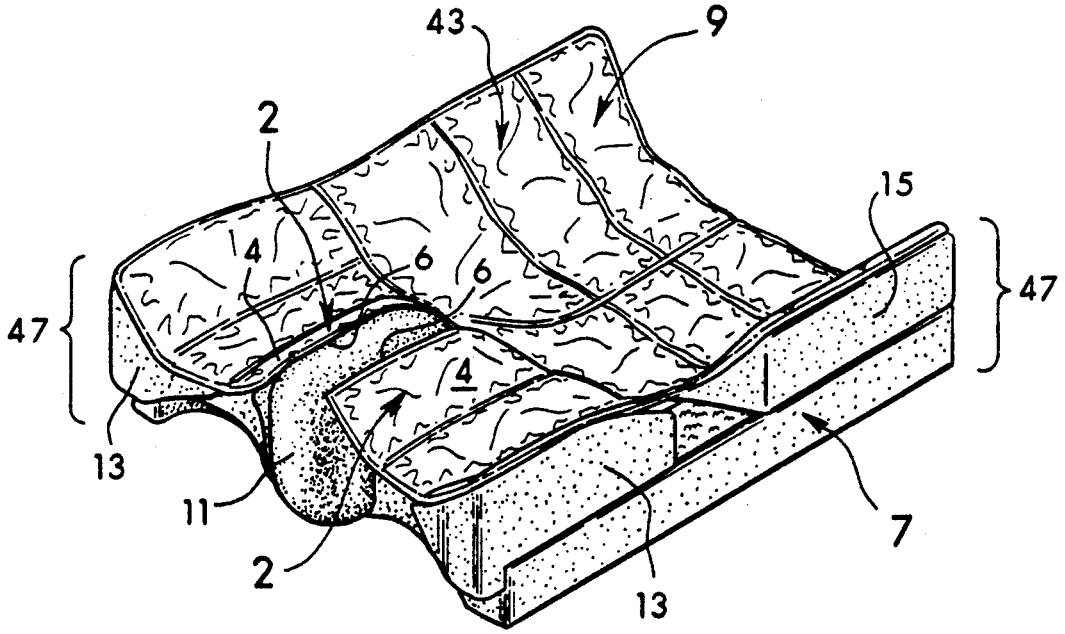
Fig. 3

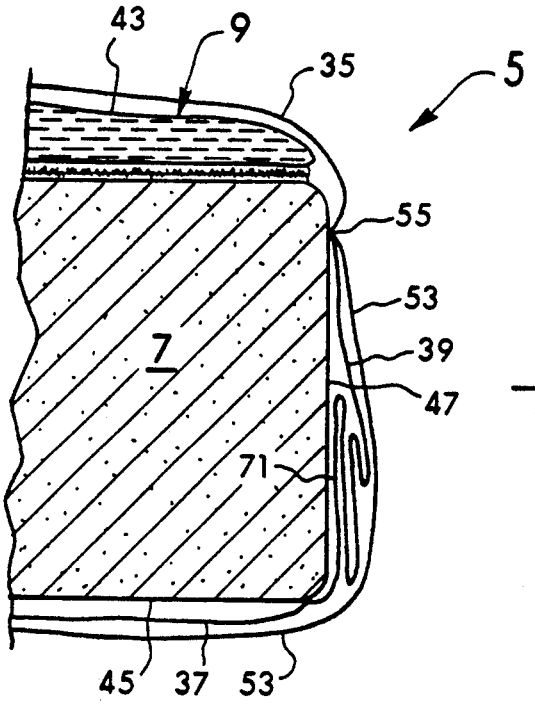
Fig. 16
Fig. 17
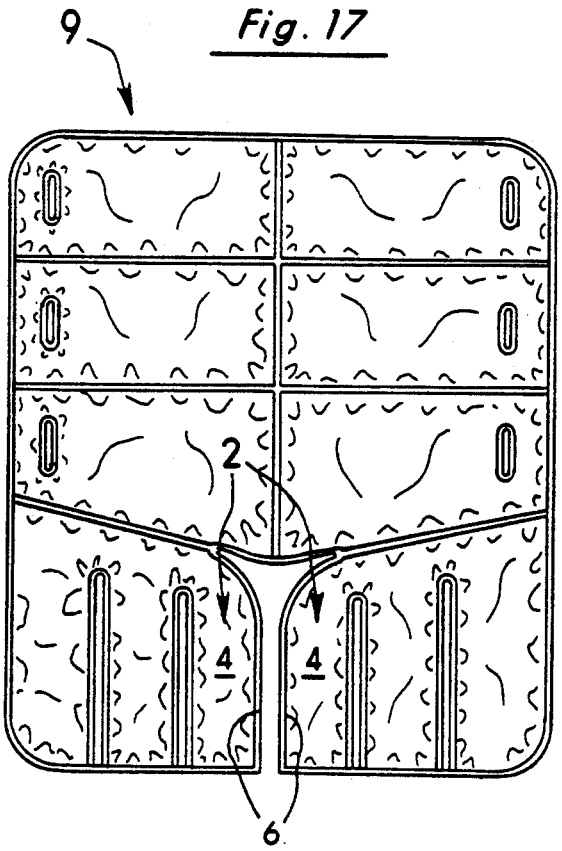
Fig. 18
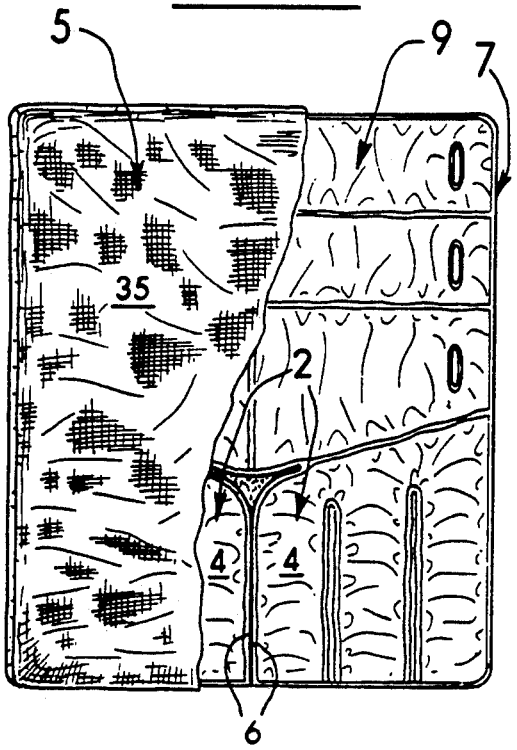

ADJUSTABLE COVER AND SEATING SYSTEM FOR A WHEELCHAIR

BACKGROUND OF THE INVENTION

1. Field Of The Invention

This invention relates to the field of adjustable covers and seating systems for wheelchairs.

2. Discussion Of The Background

Current covers for wheelchair seating systems are generally of two types. The first type essentially resembles an elastic shower cap in overall look and operation. The second type in contrast commonly includes a zipper or other closure and actually fits over and completely encloses or encases the underlying seating members.

The shower cap or stretch type cover has the advantage that accessories such as abductors, adductors, and hip guides as well as fluid pads can be selectively added on top of the basic seating member or cushion and the cap will stretch to accommodate them. To do so, the shower cap type cover commonly has an elastic band about its open end. In use, the elastic band essentially expands and contracts as needed to properly fit the cap over the particular seating arrangement (e.g., base seating cushion alone or with various combinations of accessories and/or fluid pads). The shower cap cover is desirably drawn relatively snugly over the top of the seating members with any excess material being drawn underneath the base cushion of the seat. If excess cap material were left on top, it could fold over on top of itself and possibly cause excessive pressure on the skin of the user. The material on the top, on the other hand, cannot be drawn so tightly that it hammocks and does not freely give way under the bony prominences (e.g., ischial tuberosities and coccyx) of the user. Excess material on the sides is also undesirable as it could catch in the wheelchair spokes. Consequently, it is further desirable to tuck any such excess material under the seat as is possible with a shower cap type cover.

The enclosing type covers commonly use a zipper and literally do enclose or encase the underlying seating members. Enclosure covers offer several advantages over shower cap type ones. For example, enclosure covers tend to be more sanitary (e.g., they can keep body fluids and dust and dirt from entering the enclosed seating members) and tend to offer some protection against damage to the bottom surface of the enclosed seat. They can be provided with a handle which is helpful particularly if the seating system is heavy. They also permit the use of non-skid material and/or fasteners (e.g., hook and loop) on their bottom surfaces which then can cooperate with non-skid and/or fasteners on the wheelchair for increased stability. However, with enclosure type covers, hammocking of the top surface and excess material gathering on the top and sides can be problems when various accessories and/or fluid pads are added or removed from the base seating cushion.

With the above in mind, the adjustable cover the present invention was developed. With it, the best features of both a shower cap or stretch cover and an enclosure cover have been combined into a superior cover design.

SUMMARY OF THE INVENTION

This invention involves an adjustable cover and seating system for a wheelchair.

The cover combines the best features of prior shower cap type and enclosure type covers. In doing so, the cover of the present invention has first and second portions. The first or enclosing portion surrounds the inner seat members (e.g., base seating cushion, abductor, leg wedges, hip guides, pelvic obliquity build-ups, fluid pad, and/or other accessories) and includes a zipper or other closure to actually enclose or encase the seat members. The second portion of the cover is a skirt section extending about the sides of the first or enclosure portion and downwardly under the lower section of the enclosure portion. The upper edge of the skirt section is attached adjacent the top of the peripheral side section of the enclosure portion and the lower edge of the skirt section includes elastic or draw string and draw stop arrangements or other means to selectively adjust the fit.

In use, the first or enclosure portion of the cover can be placed over the seating members and secured in place by the zipper. The draw or elastic arrangements on the lower edge of the skirt section can then be pulled to draw the skirt section downwardly. This, in turn, draws the upper section of the enclosure portion snugly across the top of the seating members. In doing so, the peripheral side section of the enclosure portion is also drawn downwardly on itself into gathers or bunches. However, the skirt section extends over and outwardly of the bunched peripheral side section to hold it firmly in place against the seating members and to present a neat outer appearance to the user and to prevent excess material from catching in the spokes of the wheelchair.

The seating system of the present invention also includes a unique slit or cut-out fluid pad. The cut-out portion of the pad forms sides which can be positioned to straddle a removable accessory such as an abductor. Additionally, the sides can be placed substantially adjacent each other on the base seating member when the removable abductor is not used. The use of the cut-out portion prevents the front of the pad from bunching up under the user's legs when the removable abductor is not being used. The use of the cut out also desirably decreases the overall weight of the fluid pad. When the removable abductor is in use, the fluid pad does not really need to be positioned over the very top portion or crown of the abductor as no parts of the user's legs or body are supported on it. If the abductor is removed, the sides of the cut out can thereafter be positioned on the base seating member next to each other to provide a surface on which the user's legs can be positioned and supported. The fluid pad with the cut-out portion can thus accommodate even a large abductor using a minimum of fluid as well as be neatly positioned over the front of the base seating cushion when the abductor is removed.

BRIEF DESCRIPTION OF THE DRAWINGS

FIG. 2 is a view of the adjustable cover and seating system of the present invention removed from the wheelchair.

FIG. 3 is a view of the seating system of FIG. 2 with the cover removed to show the underlying base seating member, accessories, and fluid pad.

FIG. 16 is an enlarged view of one side of the adjustable cover and seating means in the arrangement of FIG. 9.

FIG. 17 is a top plan view of the slit fluid pad showing its cut-out portion in the front.

FIG. 18 is a top plan view of the fluid pad positioned directly on the base seating member with the accessories of FIG. 3 removed.

DETAILED DESCRIPTION OF THE PREFERRED EMBODIMENTS

Figure 1:
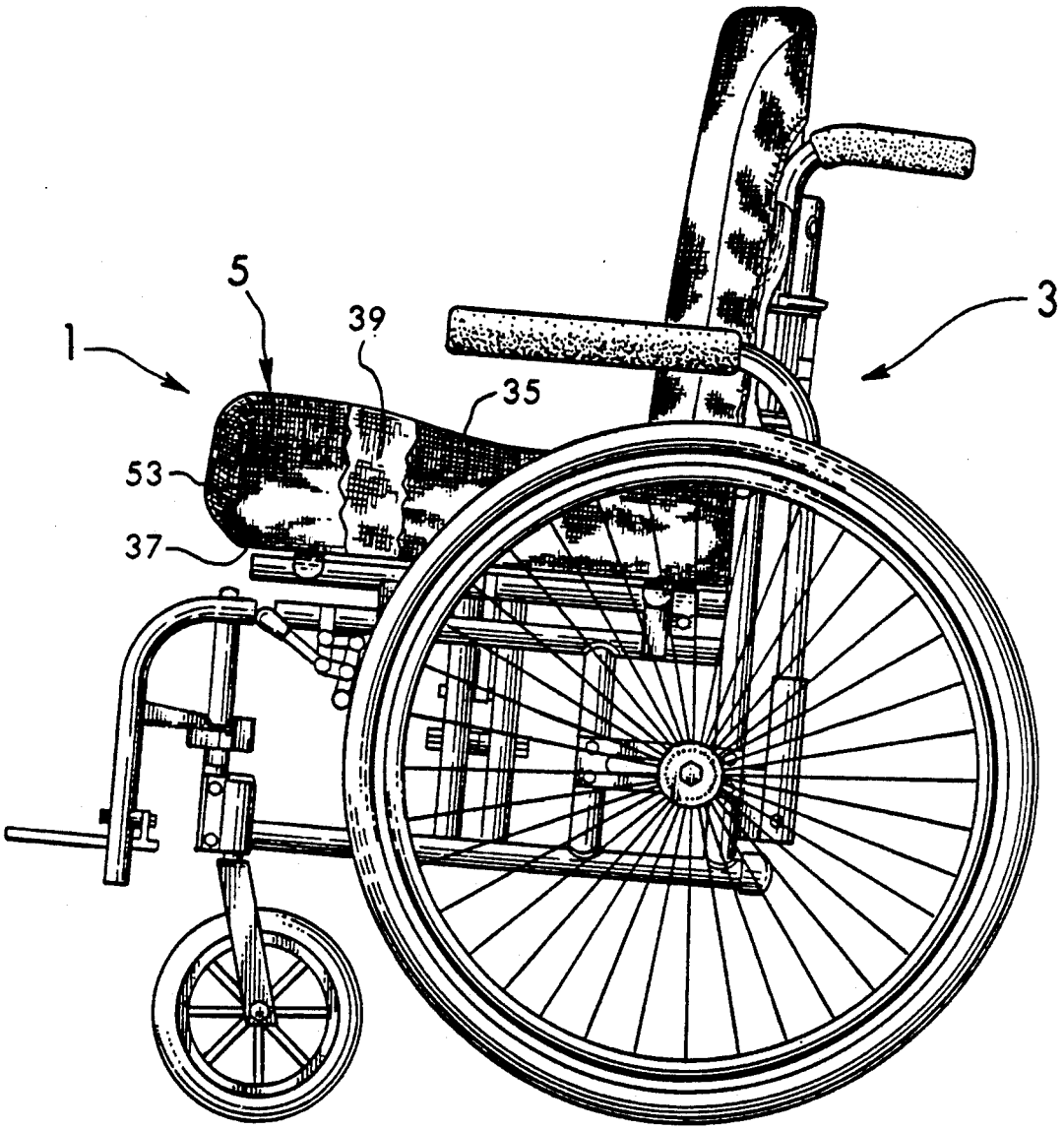
FIG. 1 is a side elevational view of a wheelchair with the adjustable cover and seating system of the present invention.

As illustrated in FIG. 1, the seating system 1 of the present invention is primarily intended for use in a wheelchair 3 but can be used independently of it if desired.

The seating system 1 as best seen in FIGS. 2-5 includes the adjustable cover 5 (see FIG. 2) positioned over the base seating member 7 (see FIG. 3) and fluid pad 9. The base seating member 7 is preferably a foam cushion but can be a relatively rigid tray. It can also be used in the present invention with or without the fluid pad 9.

Figure 4:
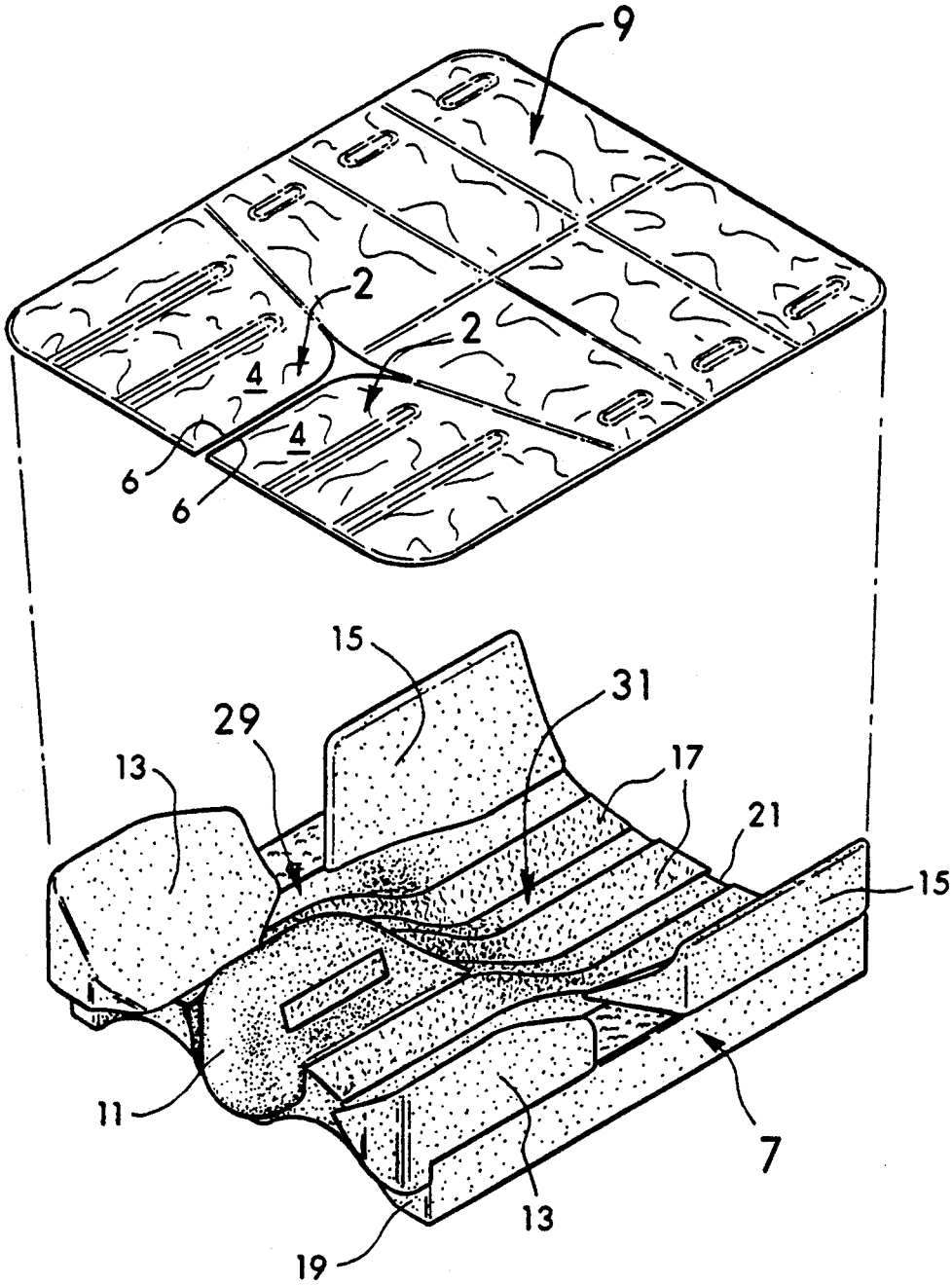
FIG. 4 is an exploded view of the base seating member and fluid pad showing the positioning of the accessories on the base seating member.
Figure 5:
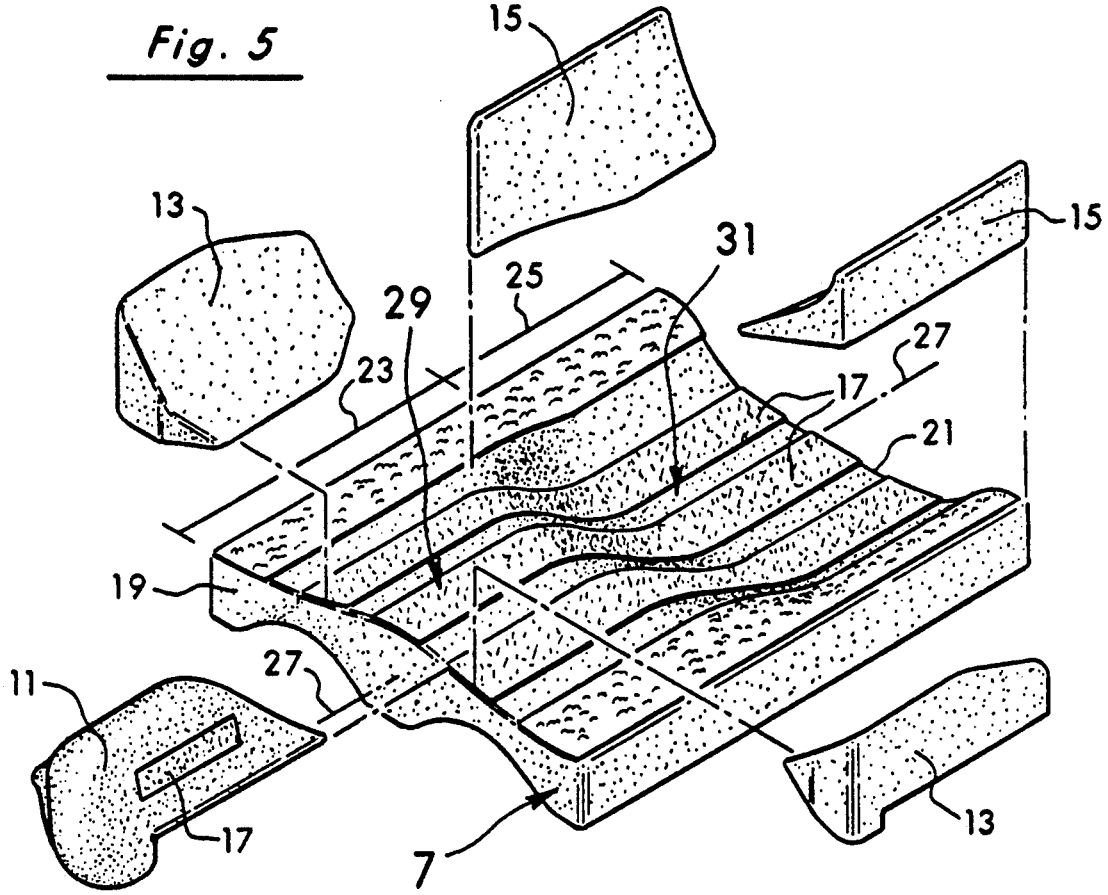
FIG. 5 is an exploded view of the base seating member and its accessories.

The base seating member 7 as shown in FIGS. 4 and 5 can have any number of accessories (e.g., abductor 11, leg wedges or adductors 13, and hip guides 15) removably attached to it (e.g., by hook and loop fasteners 17). The base seating member 7 itself as best seen in FIG. 5 has front and rear surfaces 19 and 21. The base seating member 7 is then essentially divided into forward and rearward sections 23 and 25 which extend adjacent one another substantially from the front surface 19 to the rear surface 21 along the central axis 27. The forward section 23 has an upper surface 29 which forms a shelf to receive and support the user's thighs. This surface 29 extends substantially along and across the central axis 27. The rearward section 25, in turn, has an upper surface 31 forming a depressed, seating well to receive and support the user's buttocks including his or her ischial tuberosities and coccyx.

In use, the accessories such as 11, 13, and 15 can be selectively mounted on the base seating member 7 as needed to properly fit the user. For example, the abductor 11 can be added to maintain and encourage proper leg separation and can be used alone on the front upper surface 29 or with leg wedges or adductors 13 which serve to limit excessive leg separation. In selectively using the accessories 11, 13, and 15 and fluid pad 9, a design problem is presented for the cover 5 in that the cover 5 must be adjustable to cover the base seating member 7 whether it is used alone or with various combinations of the accessories 11, 13, and 15 and/or fluid pad 9. Additionally, it is desirable to have such an adjustable cover at all times enclose or encase the seating means (whether the enclosed seating means is just the base seat member 7 alone or with various combinations of the accessories and/or fluid pad 9). Also, at the same time, it is desirable that the adjustable cover permit the upper section 35 (see FIG. 2) of the cover 5 to be drawn so that it does not lie too loosely over the seating arrangement (be it an arrangement of base seating member 7 alone or with members 11, 13, 15, and/or 9) yet is not drawn so tightly that undesirable hammocking occurs.

Figure 6:
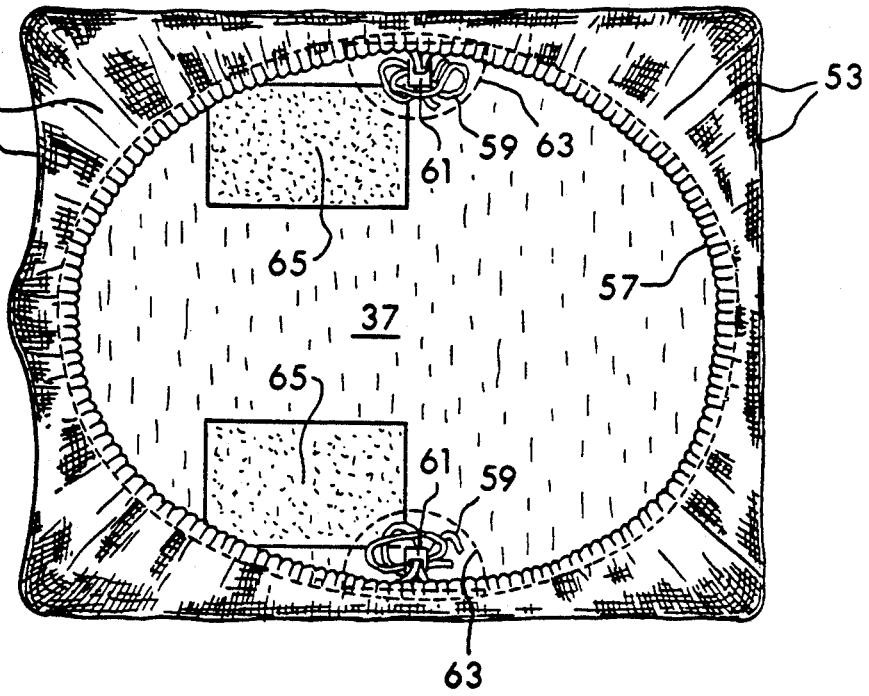
FIG. 6 is a bottom plan view of the adjustable cover and seating system taken along lines 6—6 of FIG. 2.
Figure 7:
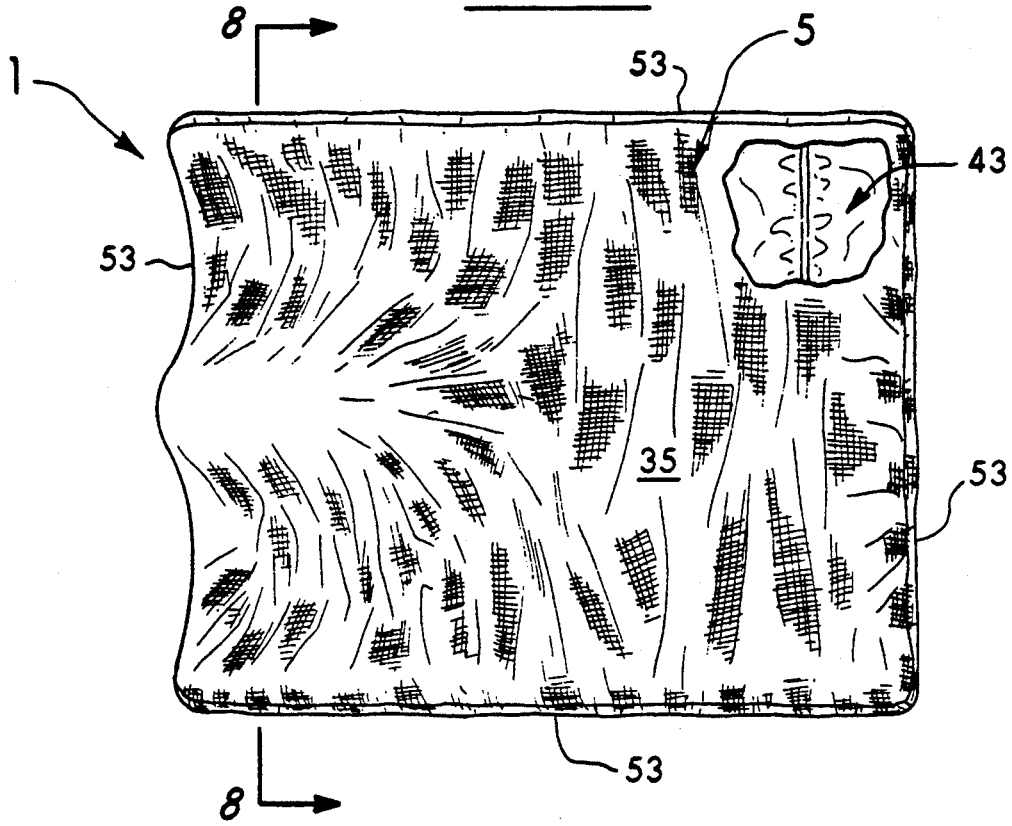
FIG. 7 is a top plan view of the adjustable cover and seating system.
Figure 8:
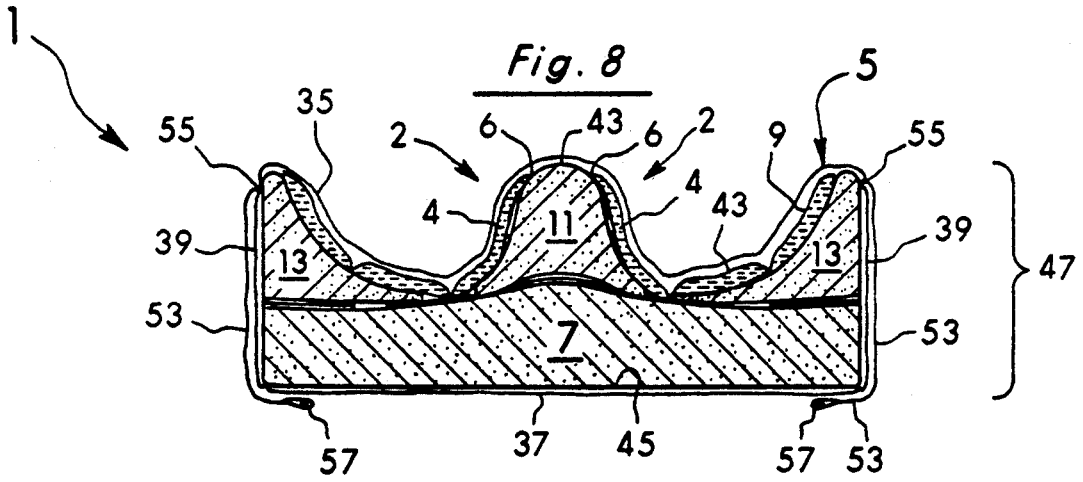
FIG. 8 is a cross-sectional view taken along line 8—8 of FIGS. 2 and 7.

To accomplish this, the cover 5 is made with two portions. The first or enclosing portion includes upper section 35 (see FIG. 2), lower section 37 (see FIG. 6), peripheral side section 39 (see FIG. 2), and zipper 41 with pulls 42 (see FIG. 14). This first or enclosing portion actually encloses or encases the inner seating means. In doing so when the seating means includes a base seat member 7, accessories 11, 13, and 15, and fluid pad 9 as in FIG. 8, the upper, lower, and peripheral side sections 35, 37, and 39 of the first or enclosing portion of the cover 5 are positioned substantially adjacent the corresponding upper, lower, and peripheral side surfaces 43, 45, and 47 of the inner seating means. The lower surface 45 of the seating means in the configuration of FIG. 8 is the lower surface 45 of the base seating member 7. The peripheral side surfaces 47 then extend upwardly from the lower surface 45 and in the view of FIG. 8, these peripheral side surfaces 47 are defined on each side by the adjacent, outer sides of the base seat member 7 and leg wedges 13. The upper surface 43 of the seating means in the configuration of FIG. 8 is then defined by the resulting upper surface created by the overlapping portions of the leg wedges 13, fluid pad 9, abductor 11, hip guides 15, and any other accessories. In the position of FIGS. 6-8, the first or enclosing portion of the cover 5 with its zipper 41 or other closing means (e.g., hook and loop fasteners) actually encases the entire inner seat means of 7, 9, 11, 13, and 15.

The second portion of the adjustable cover 5 is a skirt section 53 (see FIG. 8) that is attached (e.g., sewn) to the first or enclosing cover portion substantially adjacent its upper section 35. In FIG. 8, this attachment of the upper edge 55 of the skirt section 53 can be adjacent the edge between the upper section 35 and peripheral side section 39 of the first cover portion. However, this attachment at upper edge 55 is preferably always positioned slightly outwardly so as never to present a seam to the user. The skirt section 53 extends about the peripheral side section 39 of the first cover portion. The skirt section 39 is preferably dimensioned to extend as shown in FIGS. 6 and 8 downwardly from its upper edge 55, over the peripheral side sections 39 of the first or enclosing cover portion, and over at least a part of the lower section 37 of the first or enclosing portion.

At the lower edge 57 of the skirt section 53 as best seen in FIG. 6, two drawing strip 59 and stop 61 arrangements are provided on each side. In use, the drawing means 59 and 61 (see FIGS. 6 and 11-13) can be operated to selectively tighten or draw together the lower edge 57 of the skirt section 39. This draws down and selectively tightens the portion of the skirt section 53 (see FIG. 8) adjacent the peripheral side section 39. This, in turn, draws the upper section 35 of the first cover portion across the upper surface 43 of the seat means 7, 9, 11, 13, and 15 to the desired tautness. Such desired tautness is essentially just short of creating any hammocking anywhere across the upper surface 43 yet not so loose as to create any undesirable folds (or at least a minimum of undesirable folds) in the surface 43.

Figure 9:
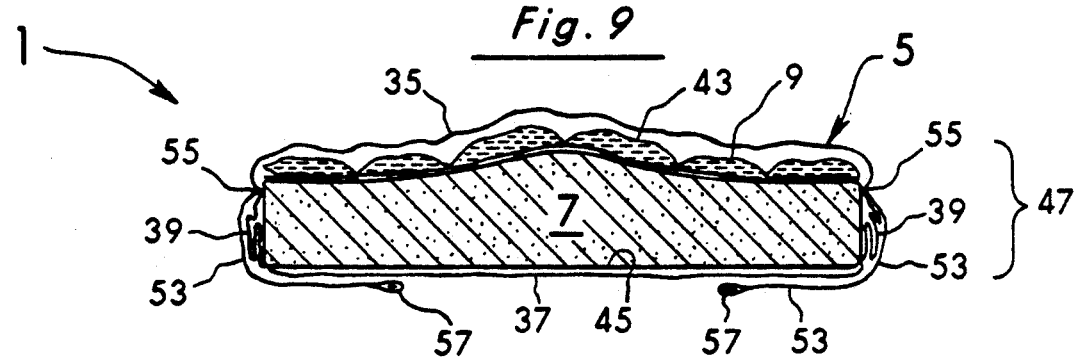
FIG. 9 is a view similar to FIG. 8 showing the general positioning of the adjustable cover when the accessories are removed and the seating arrangement includes just the base seating member and the fluid pad.
Figure 10:
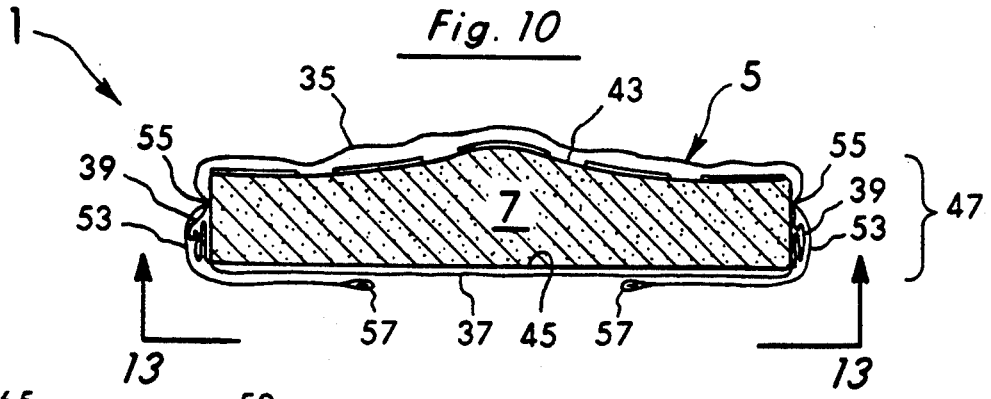
FIG. 10 is a view similar to FIG. 9 showing the general positioning of the adjustable cover when just the base seating member is used in the seating system.
Figure 11:
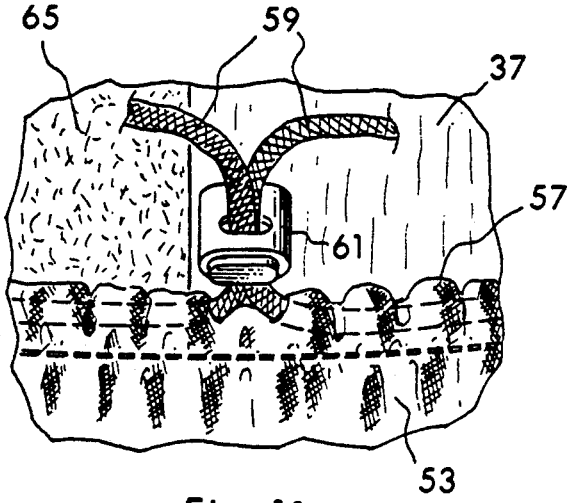
FIG. 11 is an enlarged view of the preferred draw string and draw stop arrangement of the present invention which is used for adjusting and maintaining the cover in the desired position.

In this manner, the seat means of 7, 9, 11, 13, and 15 is provided both with the sanitary and protective advantages of an enclosed cover and the easily adjustable fit advantages of an elastic, shower cap type cover. Further, these advantages are additionally present when one or more or all of the accessories 11, 13, and 15 are removed leaving just the base seating member 7 and fluid pad 9 (see FIG. 9) and are even still present when the fluid pad 9 is removed leaving only the base seating member 7 (see FIG. 10). More specifically as shown in FIG. 9, when one or more or all of the accessories 11, 13, and 15 are removed and the cover 5 is again positioned over the remaining seat means of just base seating member 7 and fluid pad 9, the drawing means 59 and 61 can be selectively drawn to pull the skirt section 53 downwardly from the position of FIG. 8 to that of FIG. 9. In doing so, the upper edge 55 of the skirt section 53 moves downwardly drawing with it the upper section 35 of the cover 5 until the desired tautness of upper section 35 is achieved as shown in FIG. 9. Similarly, if the fluid pad 9 is thereafter removed, the skirt section 53 and upper section 35 can be further drawn as shown in FIG. 10 to the desired positions.

Figure 12:
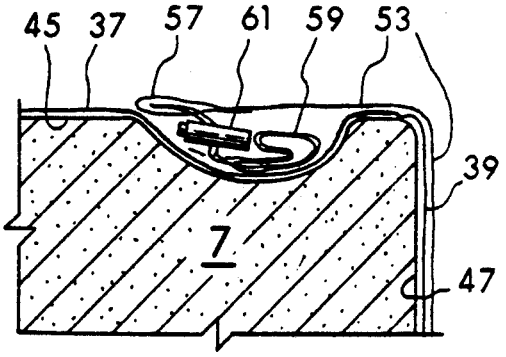
FIG. 12 is a view taken along line 12—12 of FIG. 13 illustrating how the draw stops and ends of the draw strings are receivable within indentations in the lower surface of the base seating member.
Figure 13:
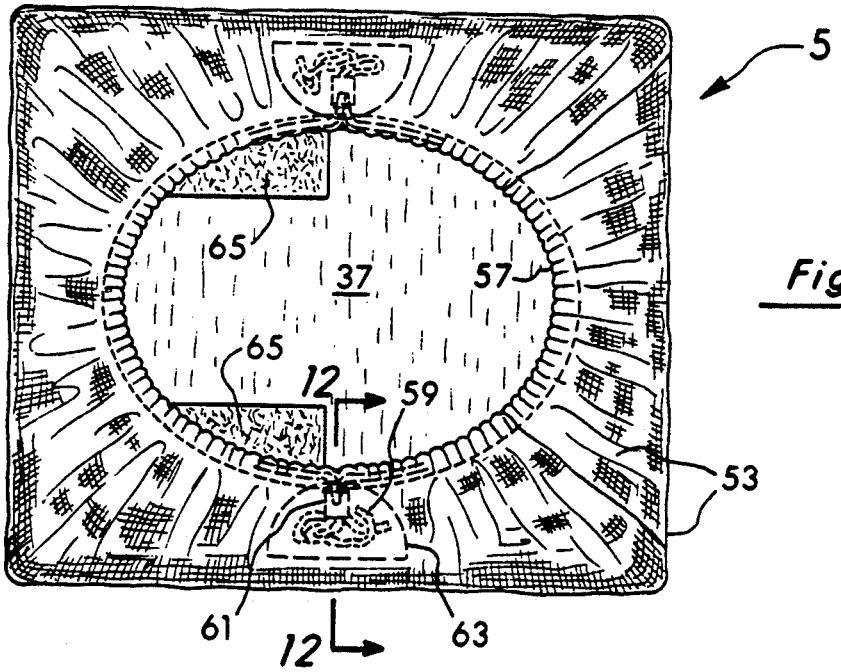
FIG. 13 is a bottom plan view similar to FIG. 6 further showing how the draw stops and ends of the draw strings are positionable in the indentations in the bottom surface of the base seating member.
Figure 14:
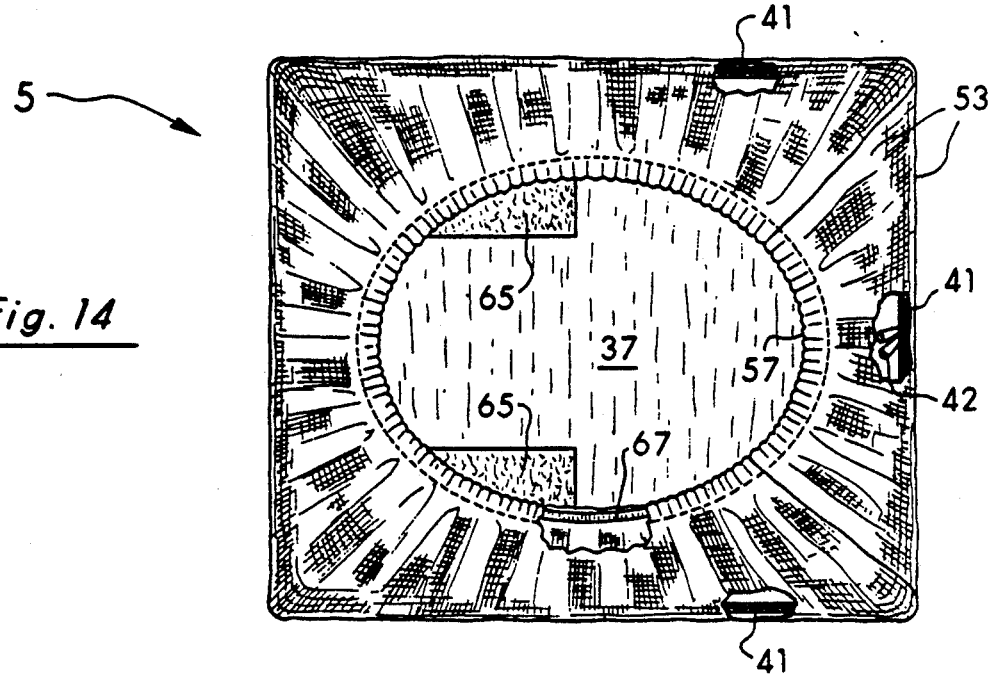
FIG. 14 is a bottom plan view similar to FIG. 13 wherein the drawing means of FIG. 13 has been replaced with a simple elastic band.

In tightening the drawing means 59 and 61 (see FIGS. 6 and 11-13), the draw strips 59 are pulled relative to the draw stops 61. Once properly tightened, the draw stops or clamps 61 as best seen in FIGS. 12 and 13 are tucked under the lower edge 57 of the skirt section 53 and received in the indentations 63 in the bottom surface 45 of the base seating member 7. In this manner, the desired flatness of surface 45 is maintained and no undesirable bulges or lumps are presented to interfere with the level sitting of the seat on the wheelchair. The drawing arrangement 59 and 61 if desired can be of the shower cap type such as shown in FIG. 14 in which an elastic band 67 serves to draw and hold the lower edge 57 of the skirt section 53 in the desired position.

The bottom or lower section 37 of the enclosing portion of the cover 5 is preferably dimensioned to be substantially the same size and shape as the underlying surface 45 of the base seating member 7 it covers. The adjustment movement in the cover 5 for proper fittings is then essentially just in the upper and peripheral side sections 35 and 39 and the skirt section 53. The lower section 37 (see FIG. 13) also desirably has a non-skid surface (e.g., fabric laminated with rubber or other non-skid material) and/or fasteners 65 (e.g., hook and loop fasteners). In this manner, the cover 5 and underlying seating means can be firmly held in place on a corresponding, non-skid surface and/or fasteners on the wheelchair (see, for example, applicant's U.S. Pat. No. 5,074,620). The lower section 37 preferably stretches very little if any while the remaining sections 35, 39, and 53 are preferably made of a material that has some stretching ability to further enhance the fit of the cover 5 over the various seating means.

Figure 15:
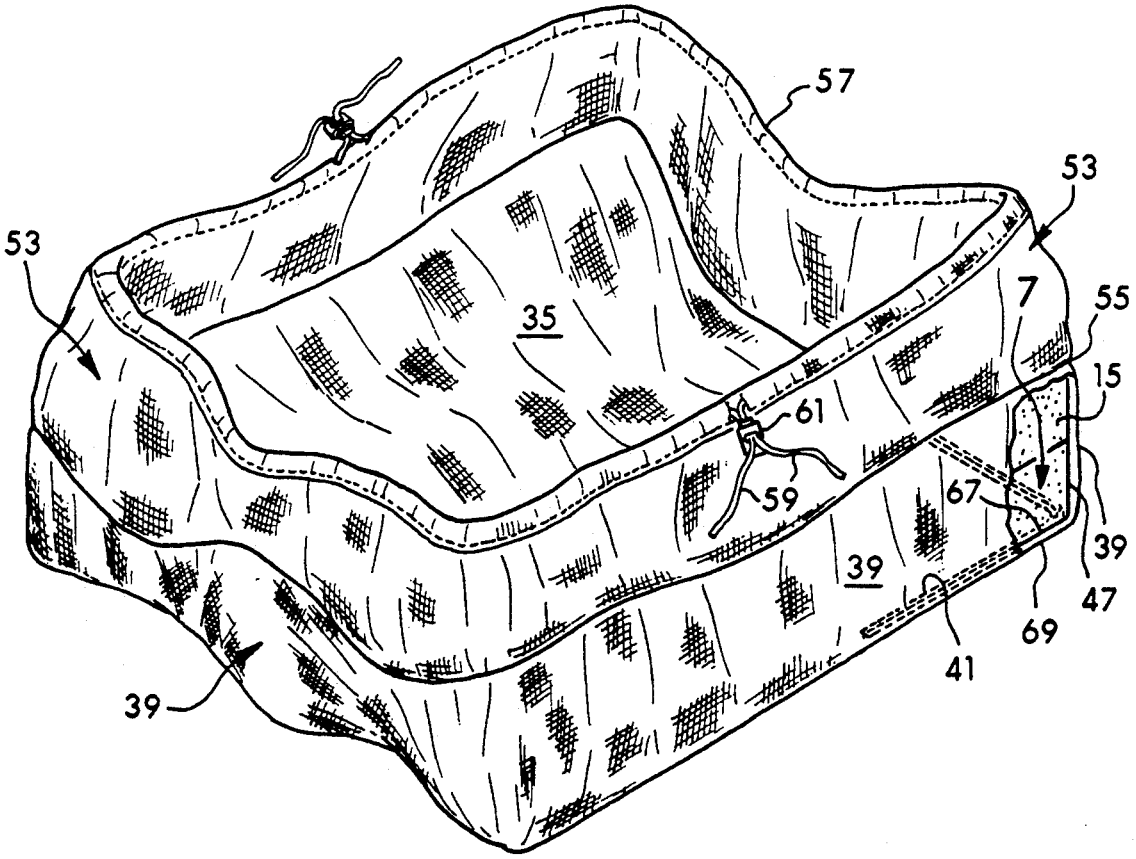
FIG. 15 is a view of the adjustable cover of the present invention with its skirt section raised to illustrate the relationship of the various parts of the cover.

The edges 67 and 69 of the lower surface 45 and the lower cover section 37 (see FIG. 15) are preferably maintained substantially adjacent each other as the drawing means 59,61 pulls the skirt section 53 and peripheral side section 39 downwardly. To help accomplish this, the cover 5 is dimensioned in its lower corners so the lower and peripheral side sections 37 and 39 fit snugly about the corners of base seating member 7. This is done essentially along the three substantially orthogonal edges or axes at each corner (see FIG. 15). This snug fit preferably extends upwardly so that when the skirt section 53 and peripheral side section 39 are drawn downwardly (see FIG. 16), the upper segment of the peripheral side section 39 does most of the adjustment moving. In doing so, it tends to bunch up on itself adjacent the lower segment 71 of the peripheral side section 39. Ordinarily, such bunching up of excess material can present a problem. However, in the design of cover 5, the skirt section 53 as shown is positioned outwardly of the bunched segment wherein the drawn skirt section 53 substantially holds the bunched up segment firmly against the seating means. This not only prevents a potential problem with excess material catching in the spokes of the wheelchair 3 but also maintains the neat overall appearance of the seating system 1.

FIGS. 3, 4, 8, 17, and 18 illustrate another improvement in the seating system 1 in which the fluid pad 9 is uniquely slit or cut at its front to create sides 2 that can straddle the abductor 11 (see FIGS. 3 and 8) In this manner, at least a portion (e.g., the crown) of the upper surface of the abductor 11 remains uncovered by the fluid pad 9. This uncovered, upper portion is an area that does not normally receive or support any part of the user's body. Consequently, desirable weight savings can be obtained in the fluid pad 9 in that less overall fluid needs to be used in the fluid pad 9. This weight savings is particularly advantageous if the fluid being used and contained in the pouches 4 is a highly viscous liquid rather than a gas. Also, when the abductor 11 is removed, the fluid pad 9 does not have excess material to bunch up under the legs as it would if it were not slit and were dimensioned to fit over abductor 11 including its crown portion.

The sides 2 of the cut-out portion of the fluid pad 9 are essentially defined by peripheral seams 6 of the pouches 4. The actual dimensioning of the fluid pad 9 allows sides 2 and pouches 4 to be positioned at least over the upwardly sloping side portions of the upper surface of the abductor 11 (see FIG. 8). These side portions in some cases will be in an area where the user's thighs may extend and need support. The fluid pad 9 is further dimensioned so that when the abductor 11 is removed (see FIG. 18), the fluid pad 9 can be positioned on the base seating member 7 with the sides 2 of the cut-out portion substantially adjacent to each other. This then provides a surface on which the user's thighs can be positioned and supported. If the cut-out portion were not included and the fluid pad 9 were dimensioned in front to extend over the top of the abductor 11, the front of the fluid pad 9 may end up with an undesirable excess of bulk in the configuration of FIG. 18. However, with the cut-out portion, the fluid pad 9 can then accommodate even a large abductor 11 as shown in FIG. 8 as well as lie neatly over the front of the base seating member 7 when the abductor 11 is removed with a minimum of excess fluid in each case.

While several embodiments of the present invention have been shown and described in detail, it is to be understood that various changes and modifications could be made without departing from the scope of the invention.

I claim:

1. An adjustable cover primarily intended for use over a seating means, said seating means having upper and lower surfaces and peripheral side surfaces extending about the seating means substantially between said upper and lower surfaces of said seating means, said adjustable cover including first and second portions, said first cover portion having upper, lower, and peripheral side sections substantially corresponding to said upper, lower, and peripheral side surfaces of said seating means and dimensioned to substantially enclose said seating means with said upper, lower, and peripheral side sections of the first cover portion substantially adjacent the corresponding upper, lower, and peripheral side surfaces of said seating means, said second cover portion including a skirt section, means for attaching said skirt section to said first cover portion substantially adjacent said upper section of the first cover portion, said skirt section being dimensioned to extend substantially about said peripheral side section of said first cover portion and to extend downwardly over at least part of said peripheral side section of said first cover portion and over at least part of the lower section of said first cover portion, said adjustable cover further including means for drawing at least a part of said skirt section over and substantially against said part of the lower section of said first cover portion and means for maintaining said part of said skirt section over and substantially against said part of the lower section, said drawing means further drawing said skirt section downwardly to draw said upper section of said first cover portion attached to said skirt section therewith and across the upper surface of said seating means.

2. The adjustable cover of claim 1 further including a pad having at least one pouch filled with fluid and means for positioning said pad over at least a part of the upper surface of said seating means.

3. The adjustable cover of claim 1 wherein said skirt section has an upper edge and said attaching means attaches said skirt section substantially adjacent said upper edge thereof substantially adjacent the upper section of said first cover portion.

4. The adjustable cover of claim 3 wherein said skirt section has a lower edge and said drawing means extends substantially about the lower edge of said skirt section.

5. The adjustable cover of claim 4 wherein said lower edge is positioned adjacent the lower section of said first cover portion.

6. The adjustable cover of claim 5 wherein said drawing means includes at least one draw string and said maintaining means includes at least one draw stop.

7. The adjustable cover of claim 5 wherein said drawing means includes at least one elastic band member.

8. The adjustable cover of claim 1 wherein said maintaining means includes at least one draw stop and the lower surface of said seating means includes at least one indention dimensioned to receive said draw stop therein.

9. The adjustable cover of claim 1 wherein the lower section of said first cover portion and the lower surface of said seating means have respective edges and said cover further includes means to maintain said edges substantially adjacent each other as said drawing means draws said skirt section downwardly.

10. The adjustable cover of claim 9 wherein said peripheral side section of said first cover portion has an upper edge of said first cover portion and extends substantially between said upper edge and the edge of the lower section of said first cover portion, said drawing means including means for drawing at least a part of said peripheral side section downwardly.

11. The adjustable cover of claim 1 wherein said peripheral side section of said first cover portion includes upper and lower segments, said drawing means draws said upper segment downwardly, and said cover means further includes means for maintaining said lower segment substantially in place adjacent the peripheral side surfaces of said seating means as said drawing means draws said upper segment downwardly.

12. The adjustable cover of claim 11 wherein the lower and peripheral side surfaces of said seating means meet and form at least two corners with each corner extending substantially along three orthogonal axes, said corresponding lower and peripheral side sections of said first cover portion being dimensioned to fit snugly about said at least two corners to thereby maintain said lower segment of the peripheral side section of said first cover portion adjacent the peripheral side surfaces of said seating means as said drawing means draws said upper segment downwardly.

13. The adjustable cover of claim 12 wherein said upper segment has an upper edge and said attaching means attaches said skirt section to the first cover portion substantially adjacent said upper edge of said upper segment wherein said upper segment bunches up adjacent the lower segment as said drawing means draws the skirt and upper segment downwardly, said skirt section being positioned outwardly of said upper segment wherein the drawn skirt section substantially holds the bunched upper segment firmly against said seating means.

14. The adjustable cover of claim 1 wherein said peripheral side section of said first cover portion has an upper edge and said attaching means attaches said skirt section to the first cover portion substantially adjacent said upper edge of said peripheral side section wherein said peripheral side section bunches up adjacent the lower section of the first cover portion as said drawing means draws the skirt and peripheral side section downwardly, said skirt section being positioned outwardly of said peripheral side section wherein the drawn skirt section substantially holds the bunched peripheral side section firmly against said seating means.

15. The adjustable cover of claim 1 wherein said cover includes closure means for enclosing said seating means within said first cover portion.

16. The adjustable cover of claim 15 wherein said closure means is a zipper.

17. The adjustable cover of claim 1 wherein the upper surface of said seating means has a first shape and said seating means includes means for changing said first shape to a modified, second shape.

18. The adjustable cover of claim 17 wherein said shape changing means includes at least one accessory and means for positioning said accessory on the first shape of the upper surface of said seating means to form said modified second shape.

19. The adjustable cover of claim 18 wherein said accessory is an abductor.

20. The adjustable cover of claim 18 wherein said accessory is an adductor.

21. The adjustable cover of claim 18 wherein said accessory is a hip guide.

22. The adjustable cover of claim 18 further including a pad having at least one pouch filled with fluid and means to position said pad over at least a part of the modified second shape of the upper surface of said seating means.

* * * * *